US006656579B1

(12) United States Patent
Kojima et al.

(10) Patent No.: US 6,656,579 B1
(45) Date of Patent: Dec. 2, 2003

(54) CONCRETE PRODUCTS FOR PROMOTION OF AFFORESTATION

(75) Inventors: Akira Kojima, Kiryu (JP); Norihiko Hirano, 14-13, Kokuryomachi 1-chome, Maebashi-shi, Gunma 371 (JP); Shigeru Furukawa, Maebashi (JP)

(73) Assignee: Norihiko Hirano, Gunma (JP)

( * ) Notice: Subject to any disclaimer, the term of this patent is extended or adjusted under 35 U.S.C. 154(b) by 0 days.

(21) Appl. No.: 09/501,311

(22) Filed: Feb. 10, 2000

Related U.S. Application Data

(63) Continuation-in-part of application No. 08/930,250, filed as application No. PCT/JP95/02008 on Oct. 3, 1995, now abandoned.

(51) Int. Cl.[7] ..... B32B 13/02

(52) U.S. Cl. ..... 428/294.7; 428/295.1; 428/296.4; 428/297.4; 428/297.1; 428/300.1; 428/300.7; 428/301.4; 428/313.5; 428/319.3; 428/327; 428/339

(58) Field of Search ..... 428/292.1, 293.4, 428/294.7, 295.1, 296.4, 297.1, 297.4, 300.1, 300.7, 301.4, 312.4, 313.5, 319.3, 327, 339

(56) References Cited

U.S. PATENT DOCUMENTS

| | | | | |
|---|---|---|---|---|
| 3,323,310 A | * | 6/1967 | Arpin | 61/3 |
| 3,775,535 A | | 11/1973 | Weisbeck | |

FOREIGN PATENT DOCUMENTS

| | | |
|---|---|---|
| JP | 46-2961 | 10/1971 |
| JP | 62-280425 | 12/1987 |
| JP | 62-276122 | 5/1988 |
| JP | 4-39862 | 9/1992 |
| JP | 07-247561 | 1/1996 |

* cited by examiner

*Primary Examiner*—Merrick Dixon
(74) *Attorney, Agent, or Firm*—Nixon Peabody LLP; Thomas W. Cole

(57) ABSTRACT

A concrete product for promotion of afforestation, to be used in an environment where a sufficient amount of water for accelerating germination of seeds is supplied. Carbon fibers are disposed on the outer surface of a concrete body. The carbon fibers are made of filaments having a strand form, non-woven fabric form, woven fabric form, knitted form, or a combination thereof.

13 Claims, 9 Drawing Sheets

CONCRETE PRODUCTS FOR PROMOTION OF AFFORESTATION

CROSS REFERENCE TO RELATED APPLICATION

This application is a continuation-in-part of U.S. Ser. No. 08/930,250 filed on Oct. 3, 1997, now abandoned, which is based on International Application Serial No. PCT/JP95/02008 filed Oct. 3, 1995.

FIELD OF THE INVENTION

The present invention relates to concrete products to be used under the environmental conditions wherein microorganisms and plants can grow. More particularly, the invention relates to concrete products for promotion of afforestation for providing the surface of the concrete product body with a green planting.

DESCRIPTION OF THE RELATED ART

Recently, the natural environment, especially the esthetics of natural and urban areas has come to be regarded as being important. Above all, because levees, retaining walls of river or seashore banks, protective walls of railway lines, side walls of roads, etc. are constructed of concrete and are unnatural in appearance, it has been proposed that such structures be of green color which is more natural.

Accordingly, there have been developed and produced concrete blocks having plant growth thereon and green-compatible concrete, etc. The concrete having plant growth has a porous structure in which the plant base materials comprising inorganic special soil dispersed with plant seeds are filled, so that the concrete surface can be covered with plant growth in several months.

The green-compatible concrete is designed to be applied to structures, with the aim of covering the roof and wall surface of buildings. It is designed to permit placement of covered soil on the surface of porous concrete and sowing of plant seeds therein.

Furthermore, water quality purifying concrete which attempts to purify water by propagating aquatic plants has been proposed. The objective of this concrete is to allow aquatic plants to grow in the pores thereof.

In the plant-grown concrete block as described above, because the seeds of plants are dispersed in advance in the space of porous concrete block, greengrowing can be attained in a short period of several months. However, the pore space in the surface of the porous concrete block in which the special soil is filled is only in the surface area of the block, and accordingly, the amount of growth is limited. Furthermore, unless the seeds are properly dispersed, plant growth can never be attained. In the case of the green-planted concrete, unless seeds are sown in the covering soil planed on the surface of the porous concrete, no growth can be attained. Furthermore, in the water purifying concrete, unless seeds of aquatic plant are planted in the pore space, a very long period of time is required before aquatic plants naturally grow. As noted above, in known green growing concrete products, unless seeds of plants are filled or planted in the concrete product, greening of the concrete medium is difficult.

SUMMARY OF THE INVENTION

The present invention has been made in consideration of the limitations of the conventional products, and its object is to provide concrete products for promotion of afforestation with which the naturally settled seeds of plants germinate and grow without it being necessary to fill or plant seeds on the concrete product body into a state in which microorganisms readily settle. In the case of use in water, the concrete product can serve to attain water purification through formation of organism membranes by settlement of microorganisms.

In order to attain the above object, in the concrete products for promotion of afforestation a first aspect of the invention is a concrete product to be used under the environment in which sufficient amount of water necessary for germination of seeds is supplied. Carbon fibers are planted on a predetermined position of the outer surface of the concrete product body.

In a second aspect of the invention, the carbon fibers are constituted by either collecting carbon fiber filaments in a strand form, or compressing filaments into non-woven fabric form, or knitting filaments into knitted goods, or weaving filaments into oven fabrics, or forming carbon into the compound shape, so that the carbon fiber is integrated into the concrete product body by embedding a part of it therein.

In a third aspect of the invention, the carbon fibers are integrated into the concrete product body by either bundling the carbon fiber filaments in a strand form, or forming the filaments at least partly into braided form and embedding a part of it in the concrete product body facing the surface layer is covered with a protective member.

In a fourth aspect of the invention, the protective member is constituted by a synthetic resin or rubber which is high in elasticity and less apt to cause damage to the carbon fiber filaments.

In a fifth aspect of the invention, there is provided a metal or resin cylindrical second protective member of high strength and excellent durability surrounding the protective member on the position facing the surface layer of the carbon fiber formed concrete product body.

Carbon fiber is charged with a positive electric charge, and the microorganisms which exist in the large number in air or water tend to be charged with negative electric charge. Accordingly, these microorganisms tend to settle on the carbon fibers planted on the surface of the concrete product body. By forming the carbon fiber filaments into a strand form, non-woven fabric form, knitted goods form, woven fabric form, or a predetermined compound shape, the surface are of the carbon fibers on which the microorganisms can settle can be large in proportion to the surface area of the concrete product body.

Under the environments wherein water is supplied to the carbon fiber, the microorganisms which settled on the carbon fiber become sludge. Especially, in a dusty environment such as the side wall of road, dust or waste floating in air is to be deposited on the carbon fiber as sludge. The plant seeds which naturally settle on the carbon fiber germinate and grow by utilizing the sludge as a nutrient.

In the case of the concrete products provided under the water level, in addition to the greening by germination and growth of seeds which float in water and settle on the carbon fiber, organism membranes are formed by the microorganisms settled on the carbon fiber, and water is purified by the membranes.

The protective member which coats the strand form or braid form carbon fiber reduces the load which acts on the root part of the carbon fiber molding planted on the concrete product body, and prevents the carbon fiber filament from coming into direct contact with the concrete body.

DETAILED DESCRIPTION OF THE PREFERRED EMBODIMENT

FIGS. 1 to 5 illustrate a first preferred embodiment in which the present invention is applied to the concrete-lined block for forming a soil-filled wall of a square face of a pond in a water pumping type dam.

Figure 1:
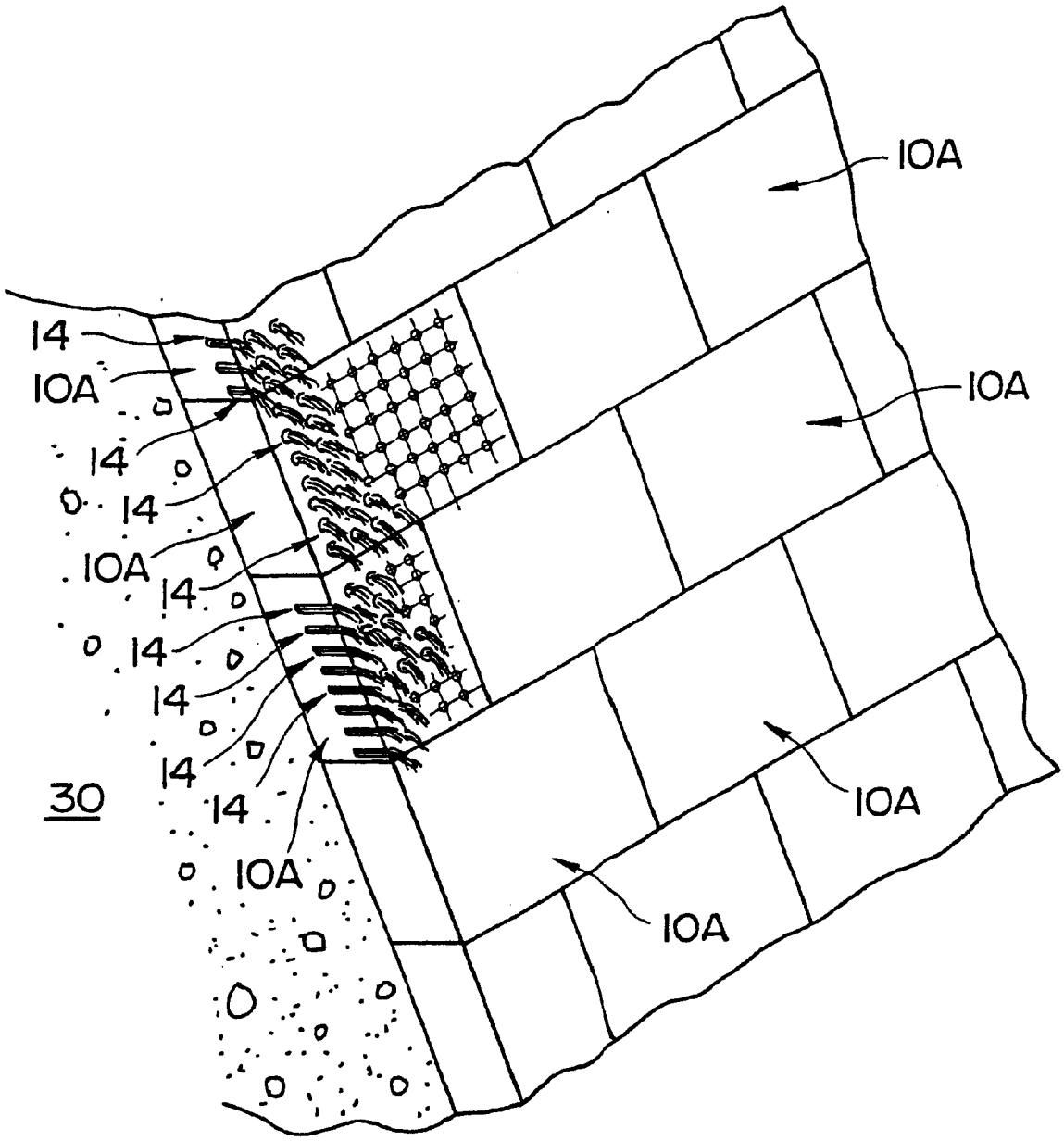
FIG. 1 is a perspective view of an earth-fill wall for forming a normal plane of a dam pond constituted by piling up concrete blocks of the first preferred embodiment of the present invention.
Figure 2:
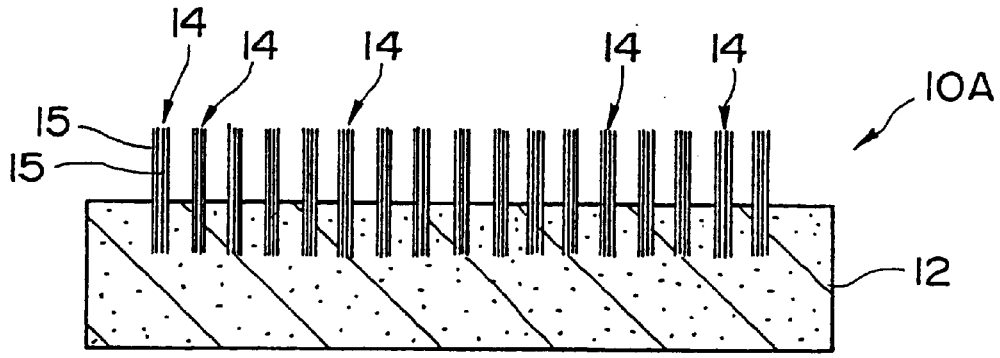
FIG. 2 is a section view of the blocks of FIG. 1.

Concrete-lined block 10A as shown in FIGS. 1 and 2 has carbon fiber strands 14 formed by bundling (several thousand–several tens of thousand filaments) very fine (e.g., several $\mu$m–several scores $\mu$m in diameter) carbon fiber filaments 15. Strands 14 are planted at a predetermined spatial distance on the surface of the rectangular flat plate type block body 12 comprising dense quality concrete to form an integral body. While the strands 14 are planted on all concrete-lined blocks 10A in FIG. 1, in the drawing, strands 14 are illustrated on only a part of the concrete-line block 10A for clarity. Preferably, the carbon fiber filaments are elastically flexible as described below.

Figure 3:
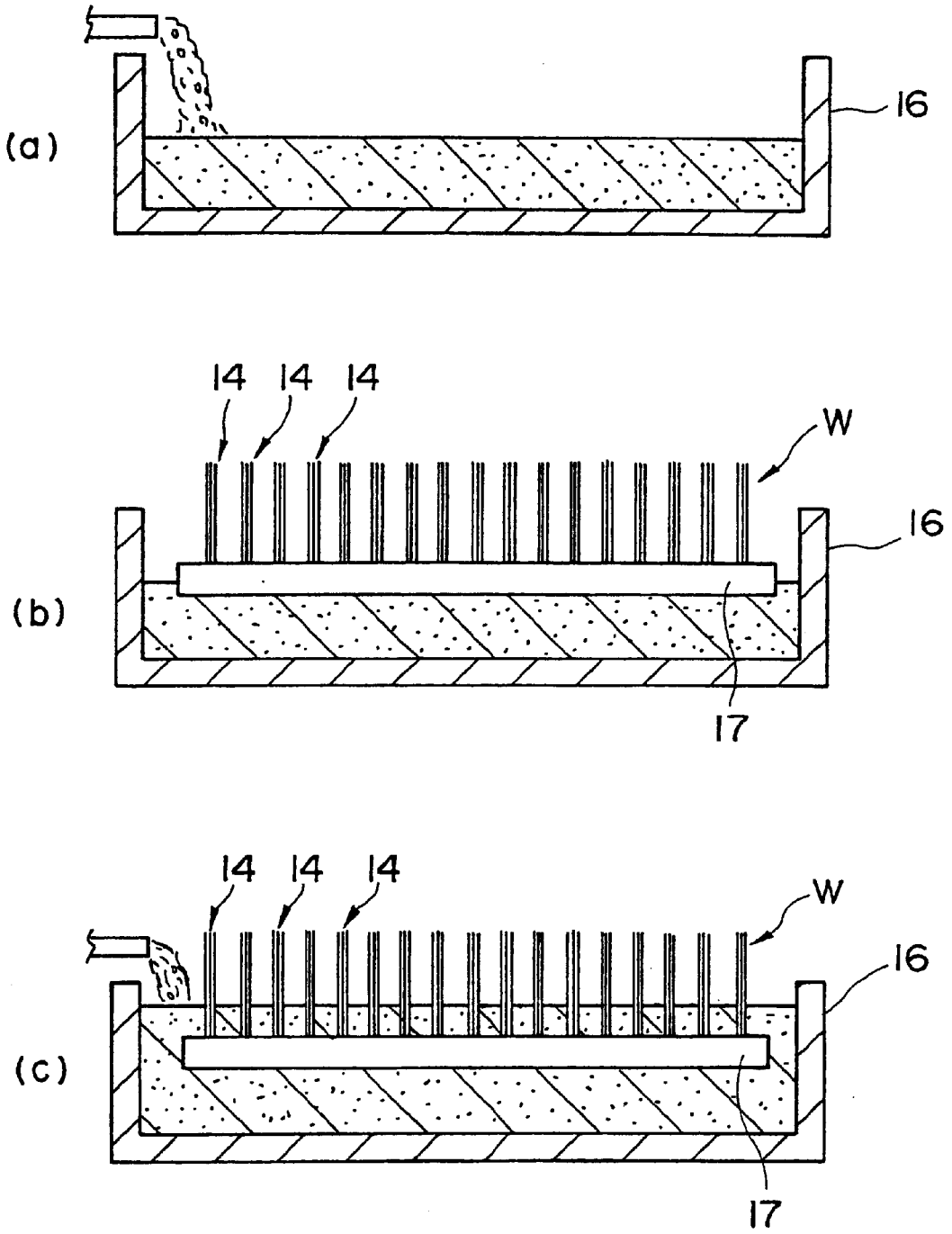
FIGS. 3*a*–3*c* illustrate the manufacturing steps of the blocks of FIG. 1.
Figure 4:
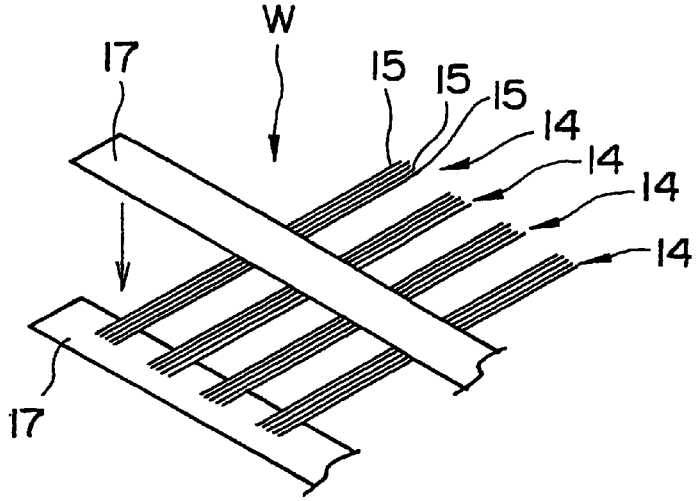
FIG. 4 illustrates the state of adhering the carbon fiber strand to a watersoluble tape.

In order to produce block 10A, firstly, as shown in FIG. 3(*a*), concrete is laid in a type frame 16 to the predetermined depth. Next, as shown in FIG. 4, in a manner to pinch the end of the carbon fiber strands 14 with band-shaped water-soluble tapes 17, the strands 14 are continuously arranged at a predetermined space to form an integral strand continuous body W. And, as shown in FIG. 3(*b*), a large number of strand continuous bodies W are held at an equal distance with the carbon fiber strands 14 upright and the tape 17 placed in the frame 16, and again the dense quality concrete is laid as shown in FIG. 3(*c*). When the concrete reaches a solidified state, the tape 17 completely dissolves in the concrete to disappear, and the carbon fiber strands 14 are planted at equal distances on the surface of the block body 12, thereby producing the concrete-lined block 10A in FIGS. 1 and 2.

Figure 5:
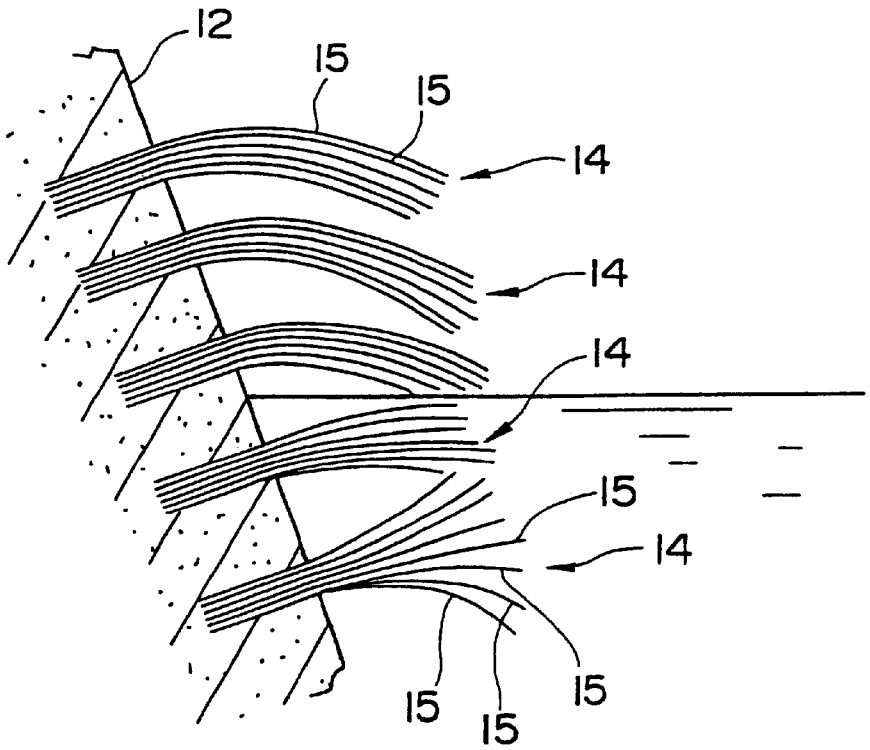
FIG. 5 illustrates the action of the carbon fiber filament of the first preferred embodiment.

Next, using the concrete-lined block 10A as an earth-fill wall for forming a normal plane of the pond of the pumping up type dam is described. The concrete blocks 10A are piled up on the crest 30 along the outer side with the carbon fiber strands 14 facing the pond. Therefore, as shown in FIG. 5, the carbon fiber strands 14 extend approximately vertically to the surface of the concrete block body 12 and flex downward due to their own weight. The carbon fiber filaments 15 are kept in a bundled state to some extent, but in water, the carbon fiber filaments 15 become separated from one another to an expanded state and sway like water-weeds or algae due to wave motions or water flow. For this reason, considering that the carbon fiber is apt to be positively charged and microorganisms tend to be negatively charged the carbon fiber filaments 15 which are always under water level attract the microorganisms living in water to settle thereon. Furthermore, because the carbon fiber filaments 15 spread and sway in water, they readily come into contact with microorganisms, and accordingly, they tend to have a large amount of settlement of microorganisms. Accordingly, the carbon fiber filaments 15 have developed organism membranes thereon and purify water. When the seeds of aquatic plants floating in water settle on the carbon fiber filaments 15, growth of the germinated aqueous plants is accelerated to reach a green condition by propagation of aquatic plants.

The water level of the pond surface in the pumping up type dam in general varies over several meters, but the carbon fiber filaments 5 which are located near the water level are always fed with water, so that the microorganisms in air or water are apt to settle on the carbon fiber filaments. For this reasons, when the seeds of the plants floating on the water surface settle on the carbon fiber filaments and germinate, the use the dead bodies of microorganisms as nutrients and exhibit accelerated growth to provide rich state of plant growth.

Figure 6:
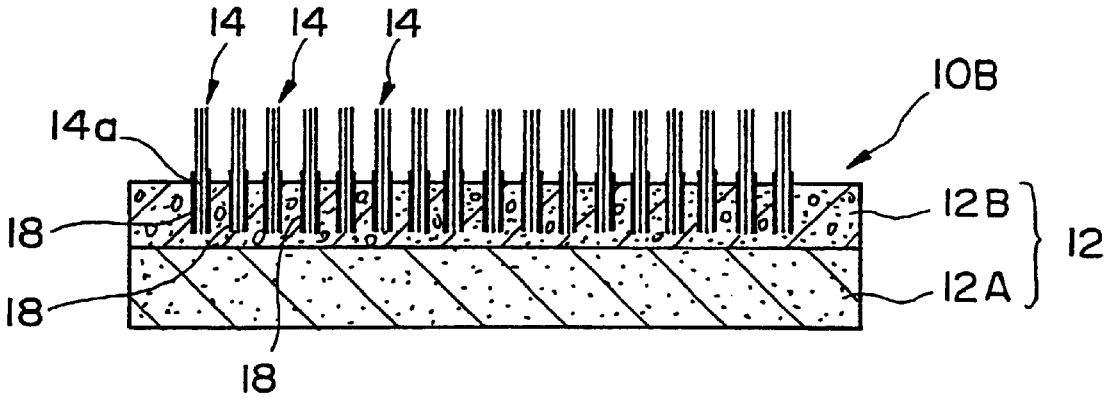
FIG. 6 is a sectional view of a concrete-plated block of a second preferred embodiment of the present invention.
Figure 7:
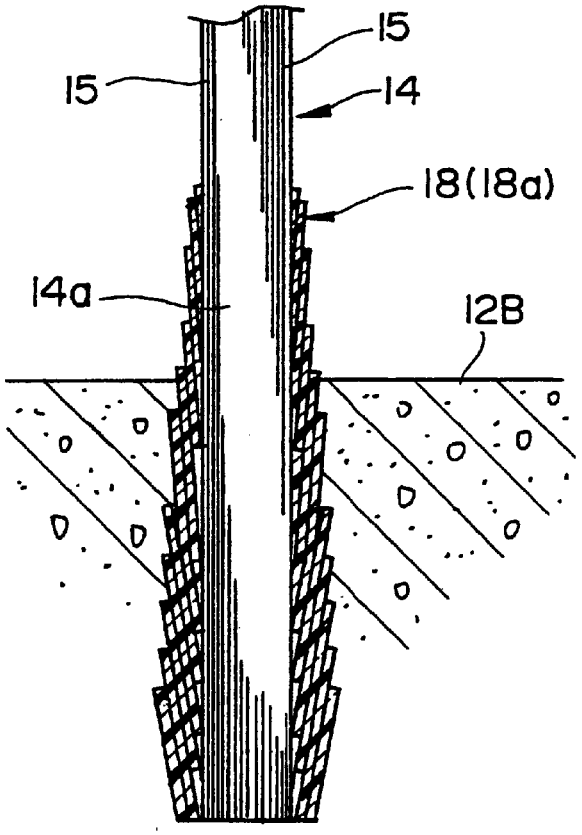
FIG. 7 is an enlarged sectional view around the lower end of a carbon fiber strand of FIG. 6.

FIG. 6 and FIG. 7 show the second preferred embodiment of the present invention. The concrete lined block 10B has a lower layer part 12A comprising dense quality concrete, on which an upper layer part 12B comprising porous concrete is laid, and carbon fiber strands 14 are planted on the upper layer part 12 to form an integral structure.

The lower end part of each strand 14 is covered with a thermoplastic film 18 as a protective member, by which the carbon filaments 15 are prevented from coming into contact with the concrete body 12, and breakage of the carbon fiber filaments 15 are prevented. Furthermore, since the carbon fiber strands 14 are covered with the plastic film 18, the bend resilience in the neighborhood of the root 14*a* of the strand is elevated and the bend stress acting on the root 14*a* of each strand is reduced, thus providing a structure less susceptible to breakage of the carbon fiber filaments 15.

The plastic film 18 is provided by winding band-like film 18*a* on each strand 14, so that the number of windings of the band-like film 18*a* is larger toward the lower part of each strand 14 to make a reverse tapered structure wherein the part of each strand 14 buried in the block body 12 is larger toward the lower end. Accordingly, due to the stopgap action (reverse tapered structure at the lower end of the strand) of the plastic film 18 each strand 14 has a longer life without sliding off and the carbon fiber filament 15 is kept vertically in an upright and sufficiently swaying condition on the upper end side by the flow of air or water.

In the second embodiment, the plastic film 18 covers the whole buried part of the strand 14 in the block body 12. However, the plastic film 18 may coat at least the position of the block body 12 facing the surface layer. The plastic film may be replaced by a rubber band. In other words, the material of the protective member to cover the carbon fiber strands 14 may be highly weather resistant resin or rubber that does not damage the carbon fiber filament.

Figure 8:
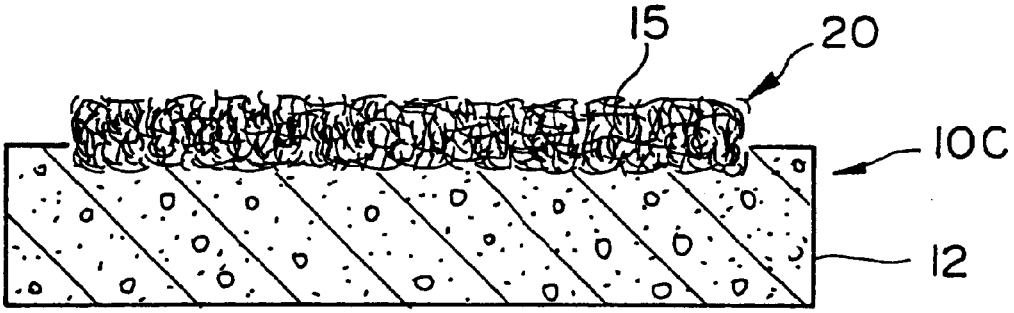
FIG. 8 is a sectional view of a concrete covered block of the third preferred embodiment of the present invention.

FIG. 8 shows the third preferred embodiment of the present invention. In concrete-lined block 10C, the whole block body 12 comprises porous concrete, and on the surface of the block body 12, a carbon fiber non-woven fabric 20 whose lower face part is imbedded in the block body 12 is laid to form an integrated body.

The carbon fiber non-woven fabric 20 is formed in a mat shape by the compression of the carbon fiber filaments 15. The carbon fiber filaments 15 are in a mutually entangled state and accordingly tend to attract and retain the micro-organisms in air or water or flying plant seeds, and are excellent in aiding growth of plants.

Figure 9:
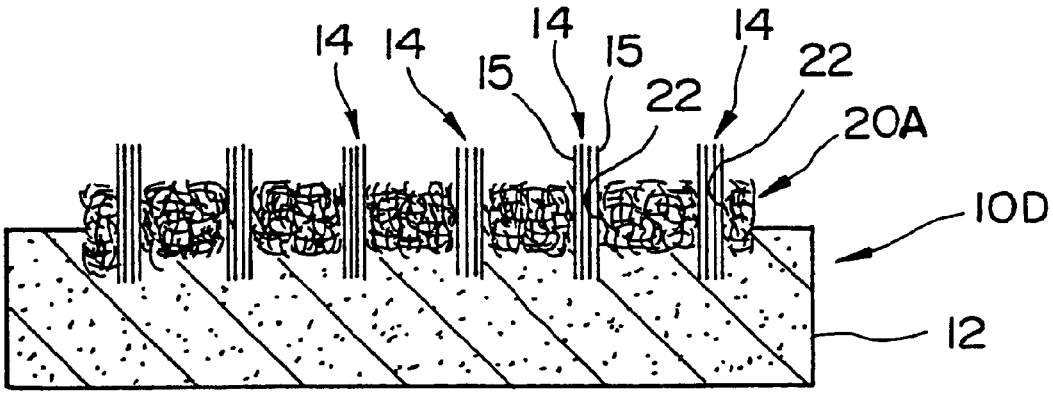
FIG. 9 is a sectional view of a concrete covered block of a fourth preferred embodiment of the present invention.
Figure 10:
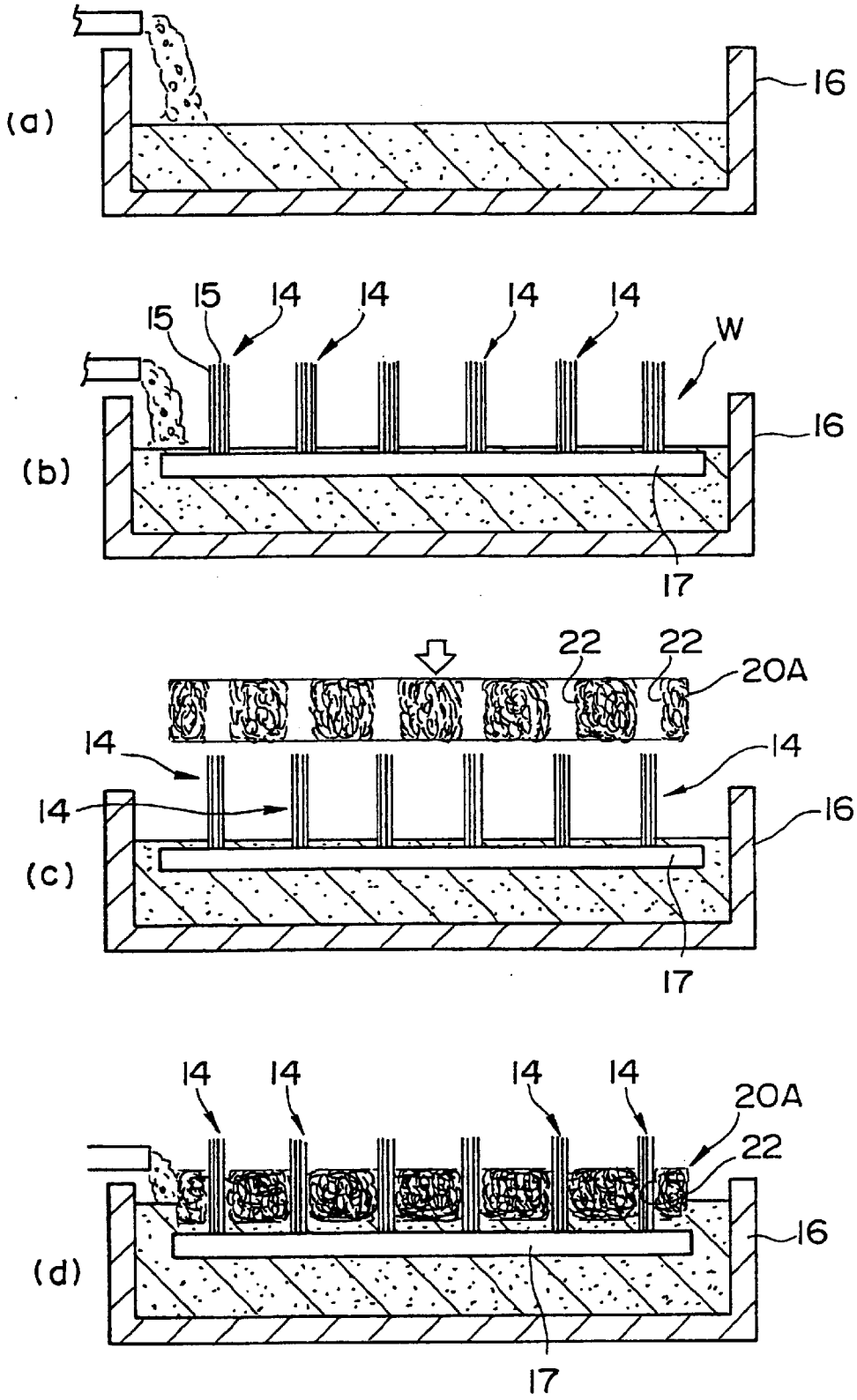
FIG. 10 illustrates the manufacturing step of the block of FIG. 9.

FIGS. 9 and 10 show the fourth preferred embodiment of the present invention. Concrete-line block 10D has a special feature in that both the carbon fiber strands 14 and the carbon fiber non-woven fabric 20A are planted on the surface of the block body 12 comprising dense quality concrete. Namely, the carbon fiber non-woven fabric 20A is provided with a large number of round holes 22, through which the carbon fiber strands 14 extend upward.

To produce this concrete-lined block 10D, firstly, as shown in FIG. 10(*a*), concrete is laid in the type frame 16 to a predetermined depth. Next, as shown in FIG. 10(*b*), strand continuous bodies W, each being made by continuously arranging the strands 14 on a water-soluble tape 17, are arranged at equal distances, and concrete is laid to a depth in which the water-soluble tape 17 is hidden. Next, as shown in FIG. 10(*c*), a carbon fiber non-woven fabric 20A is placed from above so that the strands 14 extend through the round holes 22, and as shown in FIG. 10(*d*), concrete is laid to the predetermined depth.

While the foregoing embodiments 1 through 4 have been explained with respect to concrete-filled blocks, the invention includes, but is not limited to, mortar blocks comprising mortar-lining, or concrete-mortar lined blocks constituted partly by concrete and partly by mortar. The definition of "concrete" as used herein is intended to include, original concrete, mortar or concrete constituted partly by mortar, for example.

In the foregoing embodiments the carbon fiber filaments are formed in a strand shape, in non-woven fabric form, or a combination thereof, but they may be formed in woven or knitted style.

Figure 11:
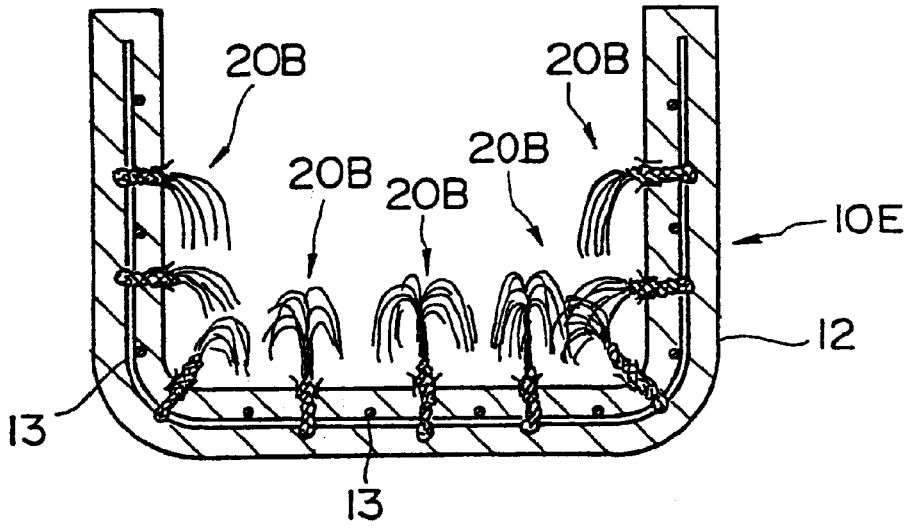
FIG. 11 is a cross sectional view of the U-shaped block of a fifth preferred embodiment of the present invention.
Figure 12:
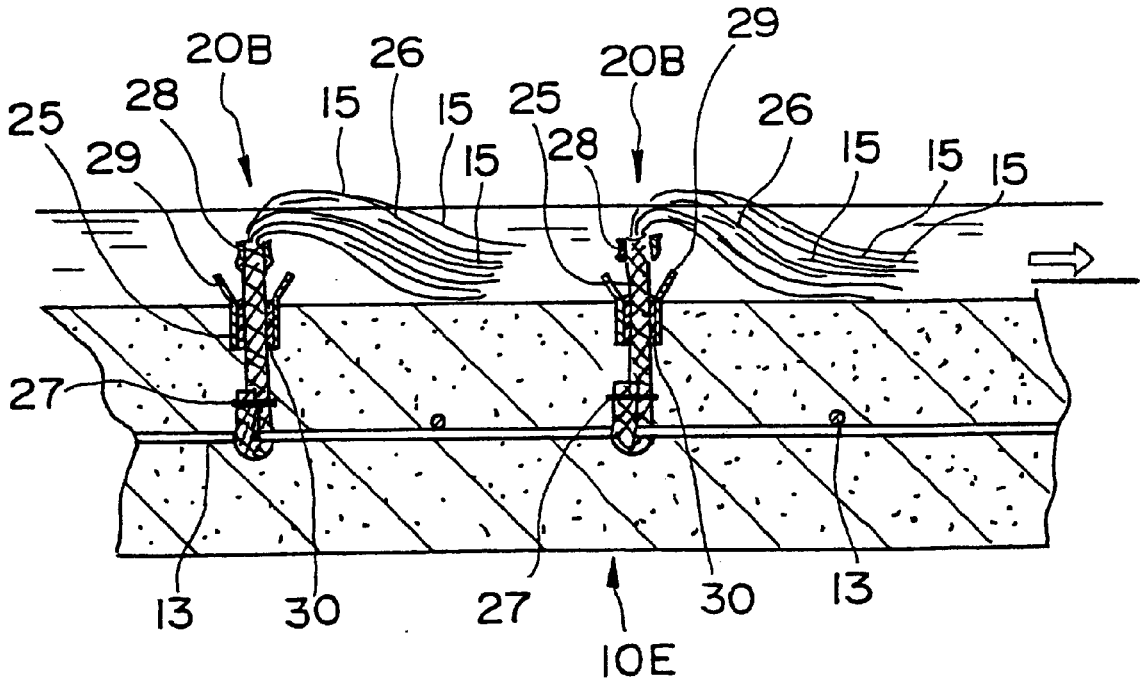
FIG. 12 is an enlarged cross-sectional view of the U-shaped block of FIG. 11.

FIGS. 11 and 12 shown an embodiment in which the present invention is applied to the U-shaped groove. The U-shaped block 10E has a construction wherein a reinforcement 13 is provided in a block body 12 having open space on the upper part with a U-shaped cross-section comprising dense quality concrete. On the inside surface of the block body 12 there are provided at an equal distance the carbon fiber formed members 20B whose base part is braided and tip side is formed in clusters.

Each carbon fiber formed member 20B is constituted by knitting the carbon fiber filaments 15 in a braid, so that the filaments become separated in cluster shape from the middle part. The braid part 25 is fixed to the reinforcement 13 by a metal clip 27, and the tip of the braid part 25 is bound with a metal clip 28 to prevent the cluster part 26 from becoming separated at the base.

That is to say, the part of the carbon fiber formed members 20B which are imbedded in the block body 12 is constituted of a stout braid 25, to be easily bound and fixed to the reinforcement 13, and to have sufficient durability to the external load acting on the carbon fiber formed members 20B. Also, the end part of the braid 25 of the carbon fiber formed members 20B is constituted in a style of clusters 26, if flexible, so that when water runs inside the U-shaped block 10E, the carbon fiber filaments 15 constituting the clusters 26, if flexible, simply spread by water flow to sway like water-weeds, thereby accelerating formation of organism membranes for purification by settlement of microorganisms.

Cylindrical metal protective member 29 having an upper end open in tapered form is provided around the braid part 25. Accordingly, the braid part 25 is prevented from coming into direct contact with the block body 12, so that the block body 12 is less apt to cause breakage of the carbon fiber filaments 15. Inside the protective member 29, a resin based adhesive is filled, and the braid 25 is covered by the highly elastic adhesive 30, and further, the outside part of the adhesive layer 30 is surrounded by protective member 29.

The positions for binding the carbon fiber formed members 20B of the reinforcement 13, clips 27, 28 and protective member 29 are covered with the insulating resin films to provide a structure which prevents electrolytic erosion between the carbon fiber and the reinforcement 13 (clips 27, 28 and protective member 29).

Also, instead of the reinforcement 13, clip 27, 28 and the insulating film to be formed on the protective member 29, or in addition to the insulating films to be formed on these members, the insulating resin film may be formed on the whole braid part 25. Further, in order to prevent electrolytic erosion, wire materials having no apprehension for electrolytic erosion with the carbon fibers may be laid along the reinforcement 13, so that the carbon fiber formed member 20B is fixed to the wire materials.

Figure 13:
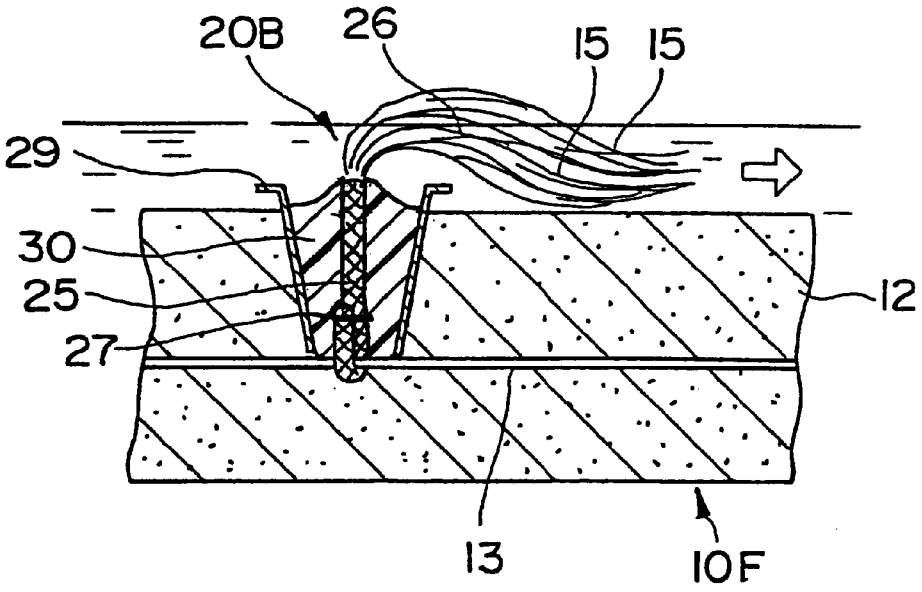
FIG. 13 is a partially enlarged cross sectional view of the U-shaped block of a sixth preferred embodiment of the present invention.
Figure 14:
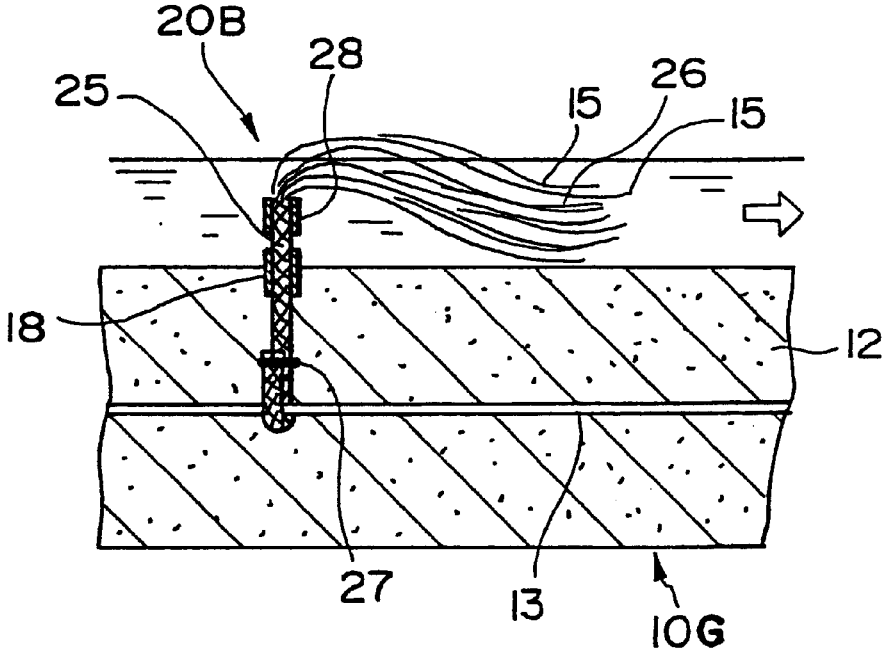
FIG. 14 is a partially enlarged cross sectional view of the U-shaped block of a seventh preferred embodiment of the present invention.

FIG. 13 and FIG. 14 show a U-shaped block according to the sixth preferred embodiment of the present invention. In the U-shaped block 10F as shown in FIG. 13, in the inner side of the cylindrical protective member 29 protecting the whole braid part 25 of the carbon fiber formed member 20B, highly elastic adhesive is filled to elevate the bend resilience of the braid part 25 and the stress acting on the braid part 25 is reduced to elevate further the durability of the braid part 25. The adhesive layer 30 is formed to rise up to the branched position between the braid part 25 and the cluster part 26 to prevent the cluster part from becoming separated.

On the other hand, U-shaped block 10G shown in FIG. 14 has a structure that the plastic film 18 is wound on the position facing the surface layer of the body 12 of the braid part 25.

Other aspects are the same as those of the foregoing fifth preferred embodiment (FIG. 11, FIG. 12), and similar reference numerals are used thus the detailed explanation thereof is omitted.

In the above first to fourth embodiments, the present intention was explained by taking an example of a concrete-lined block which can be utilized as a levee or soil stoppage in the product of soil structure, and in the fifth, sixth, and seventh embodiments, the invention was explained with an example of U-shaped block. However, the present invention can be applied to various other concrete blocks or box culverts for levee and earth filling. Further, the present invention can be applied to various concrete products for land road and road flat plate for footpath, blocks for coating, U-shaped grooves, PC girders, etc., and various concrete products for railway use including ties, railway line slabs, and the like. Furthermore, the invention can be applied to various concrete products for crossing culverts, rainwater receivers, marine concrete products including harbor and bay use such as wind suppressing blocks, fisheries, shore construction, etc., concrete products for gardening including blocks for flower beds, decorative flat boards, etc., and concrete products for construction including flower bed blocks, decorative blocks, PC plates, etc. Namely, the present invention is applicable to any a concrete product having at least a periodic supply of water by water supply means such as a sprinkler and be used under the environment in which the seeds of plants can germinate.

As noted above, there are advantages associated with the use of carbon fiber filaments that are elastically flexible to a degree that permits the filaments to sway in water. However, any type of carbon fiber filaments can be used with the invention. For example the carbon fiber filaments can be relatively rigid, very flexible, or only somewhat flexible. Applicant has found that carbon fibers having a Young's modulus in the range of 150–400 GPa (about 15300–40800 kgf/mm$^2$), inclusive, are desirable for use in the invention because such fibers readily separate and sway in water. Further, applicant has found that carbon fibers having a Young's modulus of about 235 GPA (about 24000 kgf/mm$^2$), are most preferable. As an example of carbon fiber filaments suitable for use in the invention, carbon fiber filaments sold under the trade name BESFIGHT HTA-12K can be used. Accordingly, the phrase "flexible carbon fiber filaments", as used herein, refers to carbon fiber filaments having a Young's modulus in the range of 150–400 GPa (about 15300–40800 kgf/mm$^2$), inclusive. Further, the carbon fibers can be made of filaments or can be made as a single integral fiber.

As apparent from the foregoing explanation, according to the concrete products for promotion of afforestation, microorganisms are apt to settle on the carbon fibers. The microorganisms become sludge, and the seeds of the plants which deposited on the carbon fibers and germinated grow by utilizing the sludge as a nutrient, so that green-growth or plant growth on the surface of the concrete products is achieved. When the concrete product according is used in water, in addition to the green-growth of growth and propagation of aquatic plants, organism membranes are formed by the microorganisms which deposited on the carbon fibers and water purification is attained.

Because of the large surface area of the carbon fibers which are a carrier for deposition of microorganisms, the amount of the microorganisms that can settle on the carbon fiber is large, and the formed microorganism membranes are large. Accordingly, the amount of the sludge which becomes the nutrient for plant growth is large, and the growth and propagation of plants become proportionally vigorous, and further green-growth of plant propagation and/or more purification of water are attained.

When a protective member is used, the carbon fiber formed member does not come into contact with the concrete body and eventually cause damage or breakage, so that the durability of the carbon fiber formed member is assured, and green-grown state can be preserved for a long period of time.

What is claimed is:

1. A concrete product for promotion of afforestation said concrete product comprising:

a concrete body; and carbon fibers constructed of bundled carbon fiber filaments, each of said carbon fibers having a first end portion embedded in said concrete body and a second end portion extending from an outer surface of said concrete body.

2. A concrete product as recited in claim 1, wherein, at said second end portion, said carbon fiber filaments are free to separate from one another.

3. A concrete product as recited in claim 2, wherein there are a plurality of said carbon fibers disposed at predetermined intervals on said outer surface of said concrete body, said concrete product further comprising a mat constructed of non-woven carbon fiber filaments disposed on the said outer surface of said concrete body with said carbon fibers extending through said mat.

4. A concrete product as recited in claim 2, wherein at least a portion of said first end portion of said carbon fibers comprises said carbon fiber filaments in a braided form.

5. A concrete product as recited in claim 3, wherein at least a portion of said first end portion of said carbon fibers comprises said carbon fiber filaments in a braided form.

6. A concrete product as recited in claim 2, further comprising a protective member covering at least a portion of said first end portion of said carbon fibers.

7. A concrete product as recited in claim 3, further comprising a protective member covering at least a portion of said first end portion of said carbon fibers.

8. A concrete product as recited in claim 7, wherein said protective member comprises one of an elastic synthetic resin material or a rubber material.

9. A concrete product as recited in claim 6, further comprising a rigid cylindrical second protective member disposed around the protective member.

10. A concrete product as recited in claim 7, further comprising a rigid cylindrical second protective member disposed around the protective member.

11. A concrete product as recited in claim 4, further comprising a reinforcing member disposed in said concrete body and a clip coupled to said first end portion and coupled to said reinforcing member.

12. A concrete product as recited in claim 1, wherein said carbon fiber filaments have a Young's modulus of about 24000 kgf/mm$^2$.

13. A concrete product for promotion of afforestation said concrete product comprising:

a concrete body; and carbon fibers having a first end portion embedded in said concrete body and a second end portion extending from an outer surface of said concrete body.

* * * * *